US007555915B2

(12) United States Patent
Kim et al.

(10) Patent No.: US 7,555,915 B2
(45) Date of Patent: Jul. 7, 2009

(54) AIR CONDITIONER

(75) Inventors: Cheol Min Kim, Anyang-si (KR); Yoon Jei Hwang, Inchun-si (KR)

(73) Assignee: LG Electronics Inc., Seoul (KR)

( * ) Notice: Subject to any disclaimer, the term of this patent is extended or adjusted under 35 U.S.C. 154(b) by 539 days.

(21) Appl. No.: 11/298,531

(22) Filed: Dec. 12, 2005

(65) Prior Publication Data

US 2006/0123841 A1 Jun. 15, 2006

(30) Foreign Application Priority Data

Dec. 10, 2004 (KR) ..... 10-2004-0104373

(51) Int. Cl.
*F25B 1/00* (2006.01)

(52) U.S. Cl. ..... 62/513

(58) Field of Classification Search ..... 62/513, 62/175, 510, 525, 197, 198, 217
See application file for complete search history.

(56) References Cited

U.S. PATENT DOCUMENTS 2,952,139 A * 9/1960 Kennedy et al. ..... 62/335
3,149,475 A * 9/1964 Gislason ..... 62/197
3,350,897 A * 11/1967 Plaster ..... 62/209
3,423,954 A * 1/1969 Harnish et al. ..... 62/222
3,435,626 A * 4/1969 Wile et al. ..... 62/196.4
4,259,848 A * 4/1981 Voigt ..... 62/113
4,918,942 A * 4/1990 Jaster ..... 62/335
5,056,329 A * 10/1991 Wilkinson ..... 62/197
5,218,830 A * 6/1993 Martineau ..... 62/73
5,232,820 A 8/1993 Lewis et al.
5,235,820 A * 8/1993 Radermacher et al. ..... 62/114
5,406,805 A * 4/1995 Radermacher et al. ..... 62/81
6,499,305 B2 * 12/2002 Pham et al. ..... 62/126
6,560,981 B2 * 5/2003 Flynn ..... 62/217
6,729,151 B1 5/2004 Thompson
7,104,084 B2 * 9/2006 Park et al. ..... 62/324.1
7,137,267 B2 * 11/2006 Murase et al. ..... 62/228.1
7,210,911 B2 * 5/2007 Ota et al. ..... 417/53
7,228,708 B2 * 6/2007 Taras et al. ..... 62/510

(Continued)

FOREIGN PATENT DOCUMENTS

EP 146279 9/2004

(Continued)

OTHER PUBLICATIONS

English Language Abstract of JP 11-142007.

(Continued)

*Primary Examiner*—William C Doerrler
(74) *Attorney, Agent, or Firm*—Birch, Stewart, Kolasch & Birch, LLP

(57) ABSTRACT

An air conditioner is disclosed which includes a pressurizer for pressurizing a suction-side refrigerant sucked into a compressor, and an auxiliary condenser for condensing a discharge-side refrigerant discharged out of the compressor. Accordingly, it is possible to raise the evaporation pressure of the suction-side refrigerant sucked into the compressor, and to reduce the condensation pressure of the discharge-side refrigerant discharged out of the compressor. As a result, the difference between the suction and discharge pressures of the compressor can be reduced, so that a reduction in compression load can be achieved. Thus, a reduction in power consumption can be achieved.

14 Claims, 3 Drawing Sheets

U.S. PATENT DOCUMENTS

| | | | | |
|---|---|---|---|---|
| 7,257,958 | B2 * | 8/2007 | Bush et al. | 62/199 |
| 2002/0014085 | A1 | 2/2002 | Sakakibara et al. | |
| 2002/0056280 | A1 * | 5/2002 | Kim | 62/222 |
| 2004/0099007 | A1 | 5/2004 | Lee et al. | |
| 2004/0118133 | A1 * | 6/2004 | Maeda et al. | 62/93 |
| 2004/0177628 | A1 * | 9/2004 | Kurata et al. | 62/160 |
| 2004/0211216 | A1 | 10/2004 | Yamasaki et al. | |
| 2005/0034473 | A1 | 2/2005 | Casar et al. | |
| 2005/0081537 | A1 | 4/2005 | Hwang et al. | |
| 2005/0081540 | A1 | 4/2005 | Hwang et al. | |
| 2005/0235685 | A1 | 10/2005 | Hyun et al. | |
| 2005/0252236 | A1 * | 11/2005 | Matsuoka et al. | 62/498 |
| 2006/0123824 | A1 | 6/2006 | Casar et al. | |
| 2006/0196225 | A1 * | 9/2006 | Han | 62/513 |
| 2006/0218965 | A1 * | 10/2006 | Manole | 62/513 |

FOREIGN PATENT DOCUMENTS

| | | |
|---|---|---|
| JP | 11-142007 | 5/1999 |
| JP | 2000-046445 | 2/2000 |
| JP | 2002-349979 | 12/2002 |
| KR | 2002 0024537 | 3/2002 |
| KR | 102004 0050477 | 6/2004 |
| WO | 01/22011 | 3/2001 |
| WO | 03/053726 | 7/2003 |

OTHER PUBLICATIONS

English Language Abstract of JP 2002-349979.
English Language Abstract of JP 2000-046445.
English Language Abstract of JP 2002-0024537.
English Language Abstract of JP 102004 0050477.

* cited by examiner

AIR CONDITIONER

BACKGROUND OF THE INVENTION

1. Field of the Invention

The present invention relates to an air conditioner, and, more particularly, to an air conditioner which is configured to reduce the difference between the suction and discharge pressures of a compressor included in the air conditioner, thereby being capable of achieving a reduction in power consumption, and thus, an enhancement in efficiency.

2. Description of the Related Art

Generally, air conditioners are used to cool or heat an indoor space, in order to form more comfortable indoor environments. Such an air conditioner sucks indoor air from an indoor space, and then discharges the sucked indoor air into the indoor space after heating or cooling the indoor air.

FIG. 1 is a schematic diagram illustrating a refrigerant cycle of a conventional air conditioner.

As shown in FIG. 1, the conventional air conditioner includes a compressor 2 which compresses a low-temperature and low-pressure refrigerant gas to a high-temperature and high-pressure state, and a condenser 4 which absorbs heat from the high-temperature and high-pressure refrigerant gas discharged from the compressor 2, and releases the absorbed heat to outdoor air in accordance with heat exchange with the outdoor air, thereby condensing the high-temperature and high-pressure refrigerant gas to a liquid state. The conventional air conditioner also includes an expansion device 6 which expands the refrigerant liquid emerging from the condenser 4 to a two-phase low-temperature and low-pressure refrigerant containing mixed refrigerant gas and liquid portions, and an evaporator 8 which absorbs heat from indoor air, and evaporates the two-phase refrigerant received from the expansion device 6 to a gas state using the absorbed heat.

The conventional air conditioner further includes an outdoor blower which is arranged at one side of the condenser 4, in order to blow outdoor air to the condenser 4, and thus, to enhance the heat exchanging efficiency of the condenser 4. The outdoor blower includes an outdoor fan 10 and a motor 12. The conventional air conditioner further includes an indoor blower which blows indoor air to the evaporator 8. The indoor blower includes an indoor fan 14 and a motor 16.

In the conventional air conditioner having the above-mentioned configuration, when the compressor 2 is driven, a high-temperature and high-pressure refrigerant gas is discharged out of the compressor 2. The discharged high-temperature and high-pressure refrigerant gas then releases heat to outdoor air while passing through the condenser 4, so that the refrigerant gas is condensed.

The condensed refrigerant is subsequently expanded to a two-phase low-temperature and low-pressure state while passing through the expansion device 8. The expanded refrigerant then passes through the evaporator 8. In the evaporator 8, the refrigerant is evaporated while absorbing heat from indoor air present in an indoor space. The evaporated refrigerant returns to the compressor 2. The above-mentioned procedure is then repeated.

Thus, the indoor space is cooled as the refrigerant absorbs heat from the indoor air in the evaporator 8.

In the conventional air conditioner, however, the compressor 2 exhibits a large difference between suction and discharge pressures. The difference between suction and discharge pressures is determined depending on the temperature of indoor air and the temperature of outdoor air. When the difference between suction and discharge pressures increases, an increase in power consumption occurs. In this regard, the conventional air conditioner has a problem of a degradation in system efficiency.

SUMMARY OF THE INVENTION

The present invention has been made in view of the problems incurred in the related art, and it is an object of the invention to provide an air conditioner which is configured to reduce the difference between the suction and discharge pressures of a compressor included in the air conditioner, thereby being capable of achieving a reduction in power consumption, and thus, an enhancement in efficiency.

In accordance with one aspect, the present invention provides an air conditioner comprising: at least one compressor which compresses a refrigerant to a high-temperature and high-pressure gas state; a condenser which condenses a discharge-side refrigerant, which is the refrigerant gas discharged out of the compressor, to a liquid state; an expansion device which expands the refrigerant liquid emerging from the condenser; an evaporator which evaporates the refrigerant liquid emerging from the expansion device to a gas state; and a pressurizer which is arranged between the evaporator and the compressor, to pressurize a suction-side refrigerant which is the refrigerant sucked into the compressor after emerging from the evaporator.

The pressurizer may comprise a first heat exchanger which causes the suction-side refrigerant sucked into the compressor after emerging from the evaporator, to heat-exchange with the refrigerant emerging from the condenser.

The pressurizer may be connected to a compressor suction line which guides the refrigerant emerging from the evaporator into the compressor, and may be connected to a condenser discharge line which guides the refrigerant discharged out of the condenser into the expansion device.

The air conditioner may further comprise an auxiliary condenser which is arranged between the compressor and the condenser, to condense the discharge-side refrigerant discharged out of the compressor.

The auxiliary condenser may comprise a second heat exchanger which causes the discharge-side refrigerant discharged out of the compressor to heat-exchange with the suction-side refrigerant sucked into the compressor.

The auxiliary condenser may cause the discharge-side refrigerant discharged out of the compressor to heat-exchange with the suction-side refrigerant under a condition in which the suction-side refrigerant has been pressurized by the pressurizer before being sucked into the compressor.

The auxiliary condenser may be connected to a compressor suction line which guides the refrigerant emerging from the evaporator into the compressor, and is connected to a compressor discharge line which guides the discharge-side refrigerant discharged out of the compressor into the condenser.

The compressor suction line may include a circulation line which guides a part of the refrigerant emerging from the evaporator directly into the compressor, and a bypass line which guides the remaining part of the refrigerant emerging from the evaporator into the pressurizer.

The bypass line may have an outlet joined to the circulation line. In this case, the air conditioner may further comprise a pressure control valve arranged in the circulation line at a region where the outlet of the bypass line is joined to the circulation line.

The air conditioner may further comprise a backward flow preventing unit which is arranged in the bypass line, to prevent the refrigerant pressurized by the pressurizer from flowing backwards to the evaporator.

The at least one compressor may comprise a plurality of compressors. In this case, the air conditioner may further comprise a common accumulator which connects the compressors.

In accordance with another aspect, the present invention provides an air conditioner comprising: a compressor which compresses a refrigerant to a high-temperature and high-pressure gas state; a condenser which condenses a discharge-side refrigerant, which is the refrigerant gas discharged out of the compressor, to a liquid state; an expansion device which expands the refrigerant liquid emerging from the condenser; an evaporator which evaporates the refrigerant liquid emerging from the expansion device to a gas state; and an auxiliary condenser which is arranged between the compressor and the condenser, to condense the discharge-side refrigerant discharged out of the compressor.

Since the air conditioner according to the present invention includes the pressurizer for pressurizing the suction-side refrigerant sucked into the compressor, and the auxiliary condenser for condensing the discharge-side refrigerant discharged out of the compressor, it is possible to raise the evaporation pressure of the suction-side refrigerant sucked into the compressor, and to reduce the condensation pressure of the discharge-side refrigerant discharged out of the compressor. As a result, the difference between the suction and discharge pressures of the compressor can be reduced, so that a reduction in compression load can be achieved. Thus, a reduction in power consumption can be achieved.

Since the pressurizer may be configured to cause the suction-side refrigerant to heat-exchange with the condensed refrigerant emerging from the condenser, and the pressurizer pressurizes the suction-side refrigerant using the temperature difference between the suction-side refrigerant and the condensed refrigerant, there are advantages in that the pressurizer can have a simple structure, and can be easily installed.

Since the auxiliary condenser may be configured to cause the discharge-side refrigerant to heat-exchange with the suction-side refrigerant, and the auxiliary condenser condenses the discharge-side refrigerant using the temperature difference between the discharge-side refrigerant and the suction-side refrigerant, there are advantages in that the auxiliary condenser can have a simple structure, and can be easily installed.

Since enhanced overcooling of the condensed refrigerant emerging from the condenser occurs, it is also possible to achieve an enhancement in cooling capacity.

BRIEF DESCRIPTION OF THE DRAWINGS

The above objects, and other features and advantages of the present invention will become more apparent after reading the following detailed description when taken in conjunction with the drawings, in which.

DESCRIPTION OF THE PREFERRED EMBODIMENTS

Hereinafter, exemplary embodiments of the present invention relating to an air conditioner will be described with reference to the annexed drawings.

Figure 1:
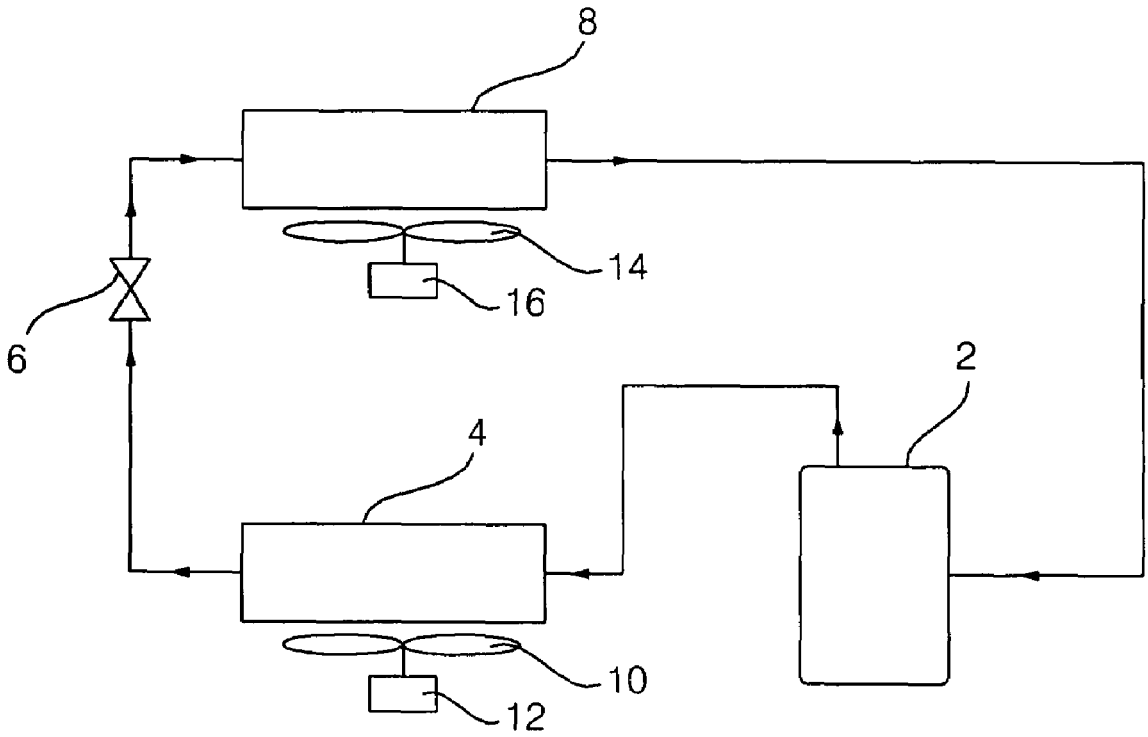
FIG. 1 (Prior Art)
FIG. 1 is a schematic diagram illustrating a refrigerant cycle of a conventional air conditioner.
Figure 2:
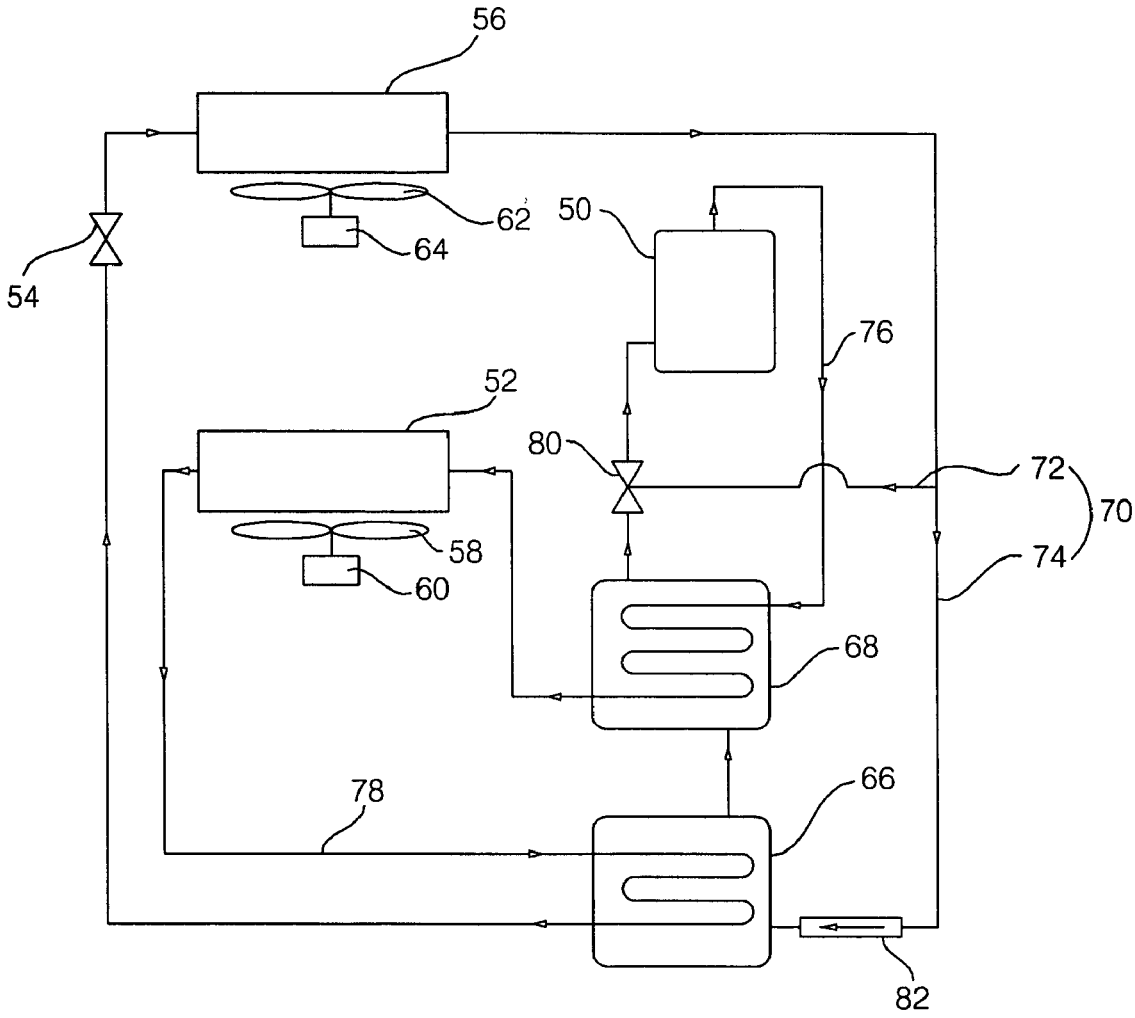
FIG. 2 is a schematic diagram illustrating a refrigerant cycle of an air conditioner according to a first embodiment of the present invention.

FIG. 2 is a schematic diagram illustrating a refrigerant cycle of an air conditioner according to a first embodiment of the present invention.

As shown in FIG. 2, the air conditioner according to the first embodiment of the present invention includes a compressor 50 which compresses a refrigerant to a high-temperature and high-pressure gas state, a condenser 52 which condenses the refrigerant gas discharged out of the compressor 50 to a liquid state, an expansion device 54 which expands the refrigerant liquid emerging from the condenser 52, and an evaporator 56 which evaporates the refrigerant liquid emerging from the expansion device 54 to a gas state. The air conditioner also includes a pressurizer which is arranged between the evaporator 56 and the compressor 50, to raise the pressure of the refrigerant sucked into the compressor 50, namely, to pressurize the refrigerant, and an auxiliary condenser which is arranged between the compressor 50 and the condenser 52, to condense the refrigerant discharged out of the compressor 50.

The air conditioner further includes an outdoor blower which is arranged at one side of the condenser 52, in order to blow outdoor air to the condenser 52, and thus, to enhance the heat exchanging efficiency of the condenser 52. The outdoor blower includes an outdoor fan 58 and a motor 60. The air conditioner further includes an indoor blower which is arranged at one side of the evaporator 56, in order to blow indoor air to the evaporator 56. The indoor blower includes an indoor fan 62 and a motor 64.

Meanwhile, the pressurizer comprises a first heat exchanger 66 which causes the refrigerant sucked into the compressor 50 after emerging from the evaporator 56 (hereinafter, referred to as a "suction-side refrigerant") to heat-exchange with the refrigerant emerging from the condenser 52. The auxiliary condenser comprises a second heat exchanger 68 which causes the refrigerant discharged out of the compressor 50 (hereinafter, referred to as a "discharge-side refrigerant") to heat-exchange with the suction-side refrigerant sucked into the compressor 50 after passing through the first heat exchanger 66.

The first heat exchanger 66 is connected to a compressor suction line 70 which is connected to the suction side of the compressor 50 to guide the refrigerant emerging from the evaporator 56 into the compressor 50. The first heat exchanger 66 is also connected to a condenser discharge line 78 which is connected to the discharge side of the condenser 52 to guide the refrigerant discharged out of the condenser 52 into the expansion device 54.

That is, to one side of the first heat exchanger 66, the compressor suction line 70 is connected in order to receive the suction-side refrigerant which is to be introduced into the compressor 50. To the other side of the first heat exchanger 66, the condenser discharge line 78 is connected in order to receive the condensed refrigerant emerging from the condenser 52.

The second heat exchanger 68 is connected to the compressor suction line 70. The second heat exchanger 68 is also connected to a compressor discharge line 76 which is connected to the discharge side of the compressor 50 to guide the discharge-side refrigerant discharged out of the compressor 50 into the condenser 52.

That is, to one side of the second heat exchanger 68, the compressor suction line 70 is connected in order to receive the suction-side refrigerant which is to be introduced into the compressor 50. To the other side of the second heat exchanger 68, the compressor discharge line 76 is connected in order to receive the discharge-side refrigerant discharged out of the compressor 50.

The compressor suction line 70 includes a circulation line 72 which guides a part of the refrigerant emerging from the evaporator 56 directly into the compressor 50, and a bypass line 74 which guides the remaining part of the refrigerant emerging from the evaporator 56 into the first and second heat exchangers 66 and 68.

At the suction side of the compressor 50, the refrigerant emerging from the circulation line 71 and the refrigerant emerging from the bypass line 74 are mixed. To this end, a pressure control valve 80 is arranged in the circulation line 72 at a region where the circulation line 72 is joined with the bypass line 74, in order to control the pressure of the mixed refrigerant.

A backward flow preventing unit 82 is arranged in the bypass line 74 in order to prevent the suction-side refrigerant, which has been pressurized in accordance with a heat exchanging operation of the first heat exchanger 66, from flowing backwards. The backward flow preventing unit 82 may comprise a check valve. The following description will be given only in conjunction with the case in which the backward flow preventing unit 82 comprises a check valve.

Hereinafter, operation of the air conditioner having the above-described configuration according to the first embodiment of the present invention will be described.

When the compressor 50 is driven, a low-temperature and low-pressure refrigerant gas, which emerges from the evaporator 56, namely, a suction-side refrigerant, is introduced into the compressor 50 via the compressor suction line 70.

In this case, a part of the suction-side refrigerant is directly introduced into the compressor 50 via the circulation line 72, and the remaining part of the suction-side refrigerant is introduced into the compressor 50 after passing through the first and second heat exchangers 66 and 68 via the bypass line 74.

The suction-side refrigerant, which will be introduced into the compressor 50 via the bypass line 74, is introduced into the first heat exchanger 66 before being introduced into the compressor 50.

Since the first heat exchanger 66 is connected to both the bypass line 74 and the condenser discharge line 78, the suction-side refrigerant introduced into the first heat exchanger 66 heat-exchanges with the condensed refrigerant discharged out of the condenser 52.

In this case, the suction-side refrigerant, which is introduced into the compressor 50 after emerging from the evaporator 56, is in a low-temperature and low-pressure state, whereas the condensed refrigerant, which emerges from the condenser 52 after being condensed, is in an intermediate-temperature and high-pressure liquid state. Accordingly, the suction-side refrigerant absorbs heat from the condensed refrigerant, and the condensed refrigerant releases heat to the suction-side refrigerant, so that the temperature of the suction-side refrigerant is increased. As a result, an increase in evaporation pressure occurs.

Thus, the suction-side refrigerant is introduced into the second heat exchanger 68 in a pressure-raised state, namely, a pressurized state.

Since the compressor discharge line 76 extends through the second heat exchanger 68, the suction-side refrigerant introduced into the second heat exchanger 68 heat-exchanges with the discharge-side refrigerant passing through the compressor discharge line 76 after being discharged out of the compressor 50.

In this case, since the discharge-side refrigerant is in a high-temperature and high-pressure state, and the suction-side refrigerant is in a low-temperature and low-pressure gas state, the discharge-side refrigerant releases heat to the suction-side refrigerant in the second heat exchanger 68. As a result, the discharge-side refrigerant is condensed, whereas the suction-side refrigerant is pressurized by virtue of the heat absorbed from the discharge-side refrigerant.

Thus, the condensation pressure of the refrigerant, namely, the discharge pressure of the compressor 50, can be lowered because the discharge-side refrigerant emerging from the compressor 50 is condensed before being introduced into the condenser 52. Also, the evaporation pressure of the refrigerant, namely, the suction pressure of the compressor 50, can be raised because the suction-side refrigerant, which will be introduced into the compressor 50, is pressurized while passing through the first and second heat exchangers 66 and 68. Accordingly, the difference between the suction and discharge pressures of the compressor 50 is reduced, thereby achieving a reduction in compression load.

Thereafter, the suction-side refrigerant emerging from the second heat exchanger 68 is introduced into the compressor 50 after passing through the pressure control valve 80, and is then discharged out of the compressor 50 in a high-temperature and high-pressure gas state.

The discharge-side refrigerant discharged out of the compressor 50 passes through the second heat exchanger 68, condenser 52, first heat exchanger 66, expansion device 54, and evaporator 56, in this order, and absorbs heat from indoor air in the evaporator 56. Thus, the indoor space is cooled. The refrigerant emerging from the evaporator 56 is returned to the compressor 50. The above-described procedure is then repeated.

Figure 3:
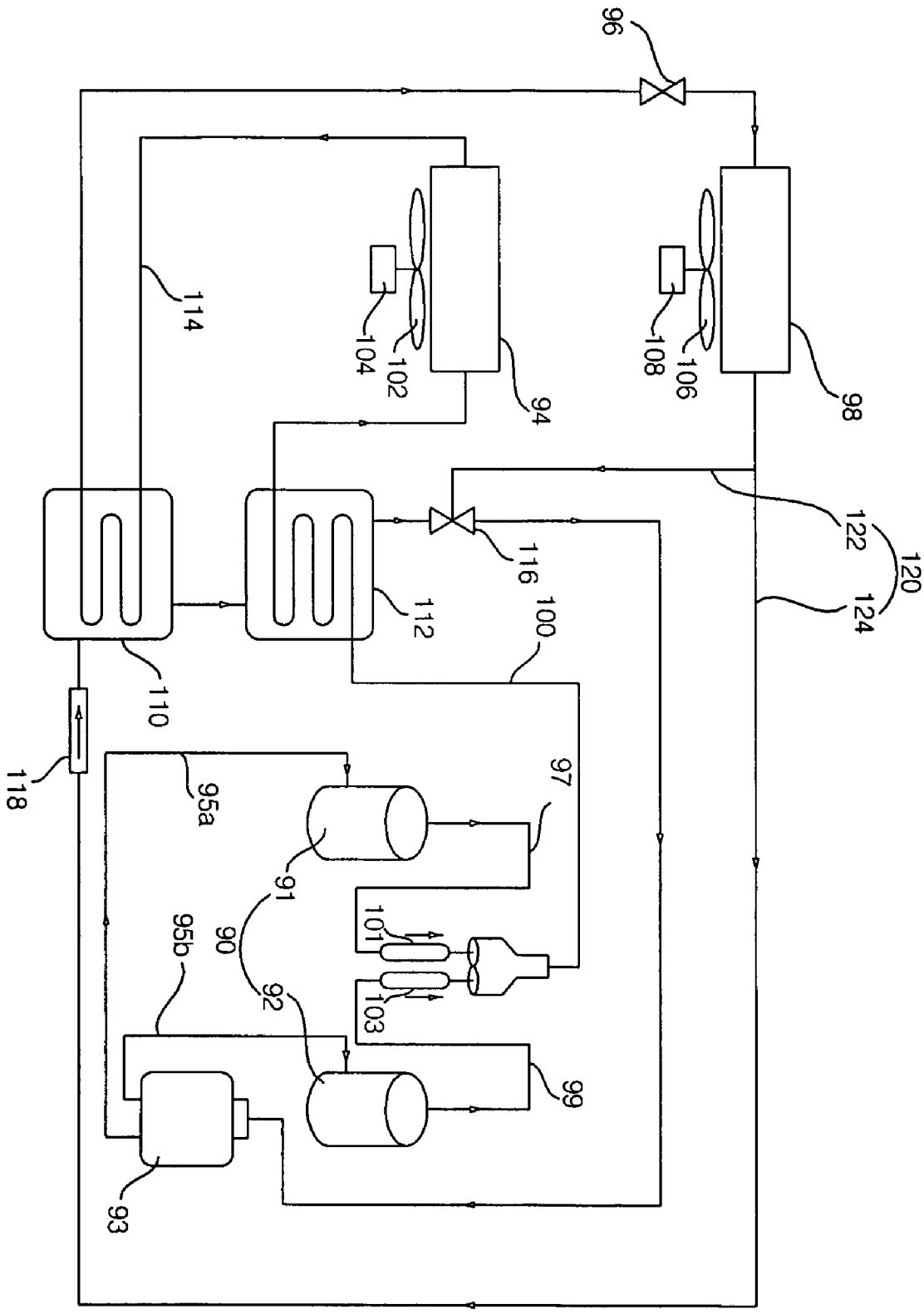
FIG. 3 is a schematic diagram illustrating a refrigerant cycle of an air conditioner according to a second embodiment of the present invention.

FIG. 3 is a schematic diagram illustrating a refrigerant cycle of an air conditioner according to a second embodiment of the present invention.

As shown in FIG. 3, the air conditioner according to the second embodiment of the present invention includes compressors 90 which compress a refrigerant to a high-temperature and high-pressure gas state, a condenser 94 which condenses the refrigerant gas discharged out of the compressors 90 to a liquid state, an expansion device 96 which expands the refrigerant liquid emerging from the condenser 94, and an evaporator 98 which evaporates the refrigerant liquid emerging from the expansion device 96 to a gas state. The air conditioner also includes a pressurizer which is arranged between the evaporator 98 and the compressors 90, to raise the pressure of the refrigerant sucked into the compressors 90, namely, to pressurize the refrigerant, and an auxiliary condenser which is arranged between the compressors 90 and the condenser 94, to condense the refrigerant discharged out of the compressors 90.

In accordance with this embodiment, the air conditioner may include a plurality of compressors 90. In this case, the compressors 90 are connected by a common accumulator 93.

In the illustrated case, two compressors 90, namely, a first compressor 91 and a second compressor 92, are included in the air conditioner. The following description will be given only in conjunction with the case in which the first and second compressors 91 and 92 are used. The common accumulator 93 is connected to first and second suction lines 95*a* and 95*b* connected to the suction sides of the first and second compressors 91 and 92, respectively.

First and second discharge lines 97 and 99 are connected to the discharge sides of the first and second compressors 91 and 92, respectively, in order to guide the refrigerant gas discharged out of the first and second compressors 91 and 92 after being compressed to a high-temperature and high-pressure state. First and second check valves 101 and 103 are arranged in the first and second discharge lines 97 and 99, respectively, in order to prevent the high-temperature and high-pressure refrigerant gas from flowing backwards.

The first and second discharge lines 97 and 99 are joined to a compressor discharge line 100. The compressor discharge line 100 guides the refrigerant, discharged out of the compressors 91 and 92 via the first and second discharge lines 97 and 99, to the condenser 94.

An outdoor blower is arranged at one side of the condenser 94, in order to blow outdoor air to the condenser 94, and thus, to enhance the heat exchanging efficiency of the condenser 94. The outdoor blower includes an outdoor fan 102 and a motor 104. An indoor blower is arranged at one side of the evaporator 98, in order to blow indoor air to the evaporator 98. The indoor blower includes an indoor fan 106 and a motor 108.

Meanwhile, the pressurizer comprises a first heat exchanger 110 which causes the refrigerant sucked into each compressor 90 after emerging from the evaporator 98 (hereinafter, referred to as a "suction-side refrigerant") to heat-exchange with the refrigerant emerging from the condenser 94. The auxiliary condenser comprises a second heat exchanger 112 which causes the refrigerant discharged out of the compressor 90 (hereinafter, referred to as a "discharge-side refrigerant") to heat-exchange with the suction-side refrigerant sucked into the compressor 90 after passing through the first heat exchanger 110.

The first heat exchanger 110 is connected to a compressor suction line 120 which is connected to the suction side of the compressors 90 to guide the refrigerant emerging from the evaporator 98 into the compressors 90. The first heat exchanger 110 is also connected to a condenser discharge line 114 which is connected to the discharge side of the condenser 94 to guide the refrigerant discharged out of the condenser 94 into the expansion device 96.

The second heat exchanger 112 is connected to the compressor suction line 120. The second heat exchanger 112 is also connected to the compressor discharge line 100 which is connected to the discharge side of the compressors 90 to guide the discharge-side refrigerant discharged out of the compressors 90 into the condenser 94.

The compressor suction line 120 includes a circulation line 122 which guides a part of the refrigerant emerging from the evaporator 98 directly into the compressors 90, and a bypass line 124 which guides the remaining part of the refrigerant emerging from the evaporator 98 into the first and second heat exchangers 110 and 112.

The circulation line 122 is connected between the outlet side of the evaporator 98 and the inlet side of the common accumulator 93. The refrigerant emerging from the bypass line 124 is mixed with the refrigerant passing through the circulation line 122. To this end, a pressure control valve 116 is arranged in the circulation line 122 at a region where the circulation line 122 is joined with the bypass line 124, in order to control the pressure of the mixed refrigerant.

A backward flow preventing unit 118 is arranged in the bypass line 124 in order to prevent the suction-side refrigerant, which has been pressurized in accordance with a heat exchanging operation of the first heat exchanger 110, from flowing backwards. The backward flow preventing unit 118 may comprise a check valve. The following description will be given only in conjunction with the case in which the backward flow preventing unit 118 comprises a check valve.

Hereinafter, operation of the air conditioner having the above-described configuration according to the second embodiment of the present invention will be described.

When each compressor 90 is driven, a low-temperature and low-pressure refrigerant gas, which emerges from the evaporator 98, namely, a suction-side refrigerant, is introduced into each compressor 90 via the compressor suction line 120.

In this case, a part of the suction-side refrigerant is directly introduced into each compressor 90 via the circulation line 122, and the remaining part of the suction-side refrigerant is introduced into each compressor 90 after passing through the first and second heat exchangers 110 and 112 via the bypass line 124.

The suction-side refrigerant emerging from the bypass line 124 is introduced into the first heat exchanger 110. In the first heat exchanger 110, the suction-side refrigerant heat-exchanges with the condensed refrigerant discharged out of the condenser 94.

In this case, the suction-side refrigerant is in a low-temperature and low-pressure state, whereas the condensed refrigerant is in an intermediate-temperature and high-pressure liquid state. Accordingly, the suction-side refrigerant absorbs heat from the condensed refrigerant, and the condensed refrigerant releases heat to the suction-side refrigerant, so that the temperature of the suction-side refrigerant is increased. As a result, an increase in evaporation pressure occurs.

Thus, the suction-side refrigerant is introduced into the second heat exchanger 112 in a pressure-raised state, namely, a pressurized state.

The suction-side refrigerant introduced into the second heat exchanger 112 heat-exchanges with the discharge-side refrigerant, discharged out of each compressor 90, in the second heat exchanger 112.

In this case, since the discharge-side refrigerant is in a high-temperature and high-pressure state, and the suction-side refrigerant is in a low-temperature and low-pressure gas state, the discharge-side refrigerant releases heat to the suction-side refrigerant in the second heat exchanger 112. As a result, the discharge-side refrigerant is condensed, thereby achieving a reduction in condensation pressure. Also, the suction-side refrigerant absorbs heat from the discharge-side refrigerant, thereby achieving a further increase in evaporation pressure.

Thus, the condensation pressure of the refrigerant, namely, the discharge pressure of each compressor 90, can be lowered because the discharge-side refrigerant is condensed in the second heat exchanger 112. Also, the evaporation pressure of the refrigerant, namely, the suction pressure of each compressor 90, can be raised because the suction-side refrigerant is pressurized while passing through the first and second heat exchangers 110 and 112. Accordingly, the difference between the suction and discharge pressures of each compressor 90 is reduced, thereby achieving a reduction in compression load.

Thereafter, the suction-side refrigerant emerging from the second heat exchanger 112 passes through the common accumulator 93 which, in turn, distributes the refrigerant into the first and second suction lines 95*a* and 95*b*, and thus, into the first and second compressors 91 and 92. The refrigerant is then compressed in the first and second compressors 91 and 92.

The discharge-side refrigerant discharged out of the first and second compressors 91 and 92 passes through the second heat exchanger 112, condenser 94, first heat exchanger 110, expansion device 96, and evaporator 98, in this order, and absorbs heat from indoor air in the evaporator 98. Thus, the indoor space is cooled. The refrigerant emerging from the evaporator 98 is returned to each compressor 90. The above-described procedure is then repeated.

As apparent from the above description, the air conditioner according to the present invention has various effects.

That is, the air conditioner according to the present invention includes a pressurizer for pressurizing a suction-side refrigerant sucked into a compressor, and an auxiliary condenser for condensing a discharge-side refrigerant discharged out of the compressor. Accordingly, it is possible to raise the evaporation pressure of the suction-side refrigerant sucked into the compressor, and to reduce the condensation pressure of the discharge-side refrigerant discharged out of the compressor. As a result, the difference between the suction and discharge pressures of the compressor can be reduced, so that a reduction in compression load can be achieved. Thus, a reduction in power consumption can be achieved.

The pressurizer is configured to cause the suction-side refrigerant to heat-exchange with the condensed refrigerant emerging from the condenser. Since the pressurizer pressurizes the suction-side refrigerant using the temperature difference between the suction-side refrigerant and the condensed refrigerant, there are advantages in that the pressurizer can have a simple structure, and can be easily installed.

The auxiliary condenser is configured to cause the discharge-side refrigerant to heat-exchange with the suction-side refrigerant. Since the auxiliary condenser condenses the discharge-side refrigerant using the temperature difference between the discharge-side refrigerant and the suction-side refrigerant, there are advantages in that the auxiliary condenser can have a simple structure, and can be easily installed.

Since enhanced overcooling of the condensed refrigerant emerging from the condenser occurs, it is also possible to achieve an enhancement in cooling capacity.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. An air conditioner, comprising:

at least one compressor which compresses a refrigerant to a high-temperature and high-pressure gas state;

a condenser which condenses a discharge-side refrigerant, which is the refrigerant gas discharged out of the compressor, to a liquid state;

an expansion device which expands the refrigerant liquid emerging from the condenser;

an evaporator which evaporates the refrigerant liquid emerging from the expansion device to a gas state;

a pressurizer which causes a refrigerant emerging from the evaporator to heat-exchange with the refrigerant emerging from the condenser, such that the refrigerant is pressurized before being sucked into the compressor, and an auxiliary condenser which causes the refrigerant discharged out of the compressor to heat-exchange with the refrigerant emerging from the pressurizer such that the refrigerant is pre-condensed before being introduced into the condenser.

2. The air conditioner according to claim 1, wherein the pressurizer is connected to a compressor suction line which guides the refrigerant emerging from the evaporator into the compressor, and is connected to a condenser discharge line which guides the refrigerant discharged out of the condenser into the expansion device.

3. The air conditioner according to claim 1, wherein the auxiliary condenser is connected to a compressor suction line which guides the refrigerant emerging from the evaporator into the compressor, and is connected to a compressor discharge line which guides the discharge-side refrigerant discharged out of the compressor into the condenser.

4. The air conditioner according to claim 1, wherein the compressor suction line includes a circulation line which guides a part of the refrigerant emerging from the evaporator directly into the compressor, and a bypass line which guides the remaining part of the refrigerant emerging from the evaporator into the pressurizer.

5. The air conditioner according to claim 4, wherein the bypass line has an outlet joined to the circulation line, further comprising:

a pressure control valve arranged in the circulation line at a region where the outlet of the bypass line is joined to the circulation line.

6. The air conditioner according to claim 4, further comprising:

a backward flow preventing unit which is arranged in the bypass line, to prevent the refrigerant pressurized by the pressurizer from flowing backwards to the evaporator.

7. The air conditioner according to claim 1, wherein the at least one compressor comprises a plurality of compressors, further comprising a common accumulator which connects the compressors.

8. An air conditioner, comprising:

at least one compressor which compresses a refrigerant to a high-temperature and high-pressure gas state;

a condenser which condenses a discharge-side refrigerant, which is the refrigerant gas discharged out of the compressor, to a liquid state;

an expansion device which expands the refrigerant liquid emerging from the condenser;

an evaporator which evaporates the refrigerant liquid emerging from the expansion device to a gas state; and an auxiliary condenser which causes a refrigerant discharged out of the compressor to heat-exchange with a refrigerant emerging from the evaporator such that the refrigerant is pre-condensed before being introduced into the condenser.

9. The air conditioner according to claim 7, wherein the auxiliary condenser is connected to a compressor suction line which guides the refrigerant emerging from the evaporator into the compressor, and is connected to a compressor discharge line which guides the refrigerant discharged out of the compressor into the condenser.

10. The air conditioner according to claim 9, wherein the compressor suction line includes a circulation line which guides a part of the refrigerant emerging from the evaporator directly into the compressor, and a bypass line which guides the remaining part of the refrigerant emerging from the evaporator into the auxiliary condenser.

11. The air conditioner according to claim 10, wherein the bypass line has an outlet joined to the circulation line, further comprising:

a pressure control valve arranged in the circulation line at a region where the outlet of the bypass line is joined to the circulation line.

12. The air conditioner according to claim 8, wherein the at least one compressor comprises a plurality of compressors, further comprising a common accumulator which connects the compressors.

13. An air conditioner, comprising:

at least one compressor which compresses a refrigerant to a high-temperature and high-pressure gas state;

a condenser which condenses a discharge-side refrigerant, which is the refrigerant gas discharged out of the compressor, to a liquid state;

an expansion device which expands the refrigerant liquid emerging from the condenser;

an evaporator which evaporates the refrigerant liquid emerging from the expansion device to a gas state;

a first heat exchanger which is arranged between the evaporator and the compressor, to cause a suction-side refrigerant, which is the refrigerant sucked into the compressor after emerging from the evaporator, to exchange heat with the refrigerant emerging from the condenser; and a second heat exchanger which is arranged between the compressor and the condenser, to condense the discharge-side refrigerant discharged out of the compressor with the suction-side refrigerant sucked into the compressors, wherein the second heat exchanger causes the suction-side refrigerant, which is sucked into the compressor after passing through the first heat exchanger, to heat exchange with the discharge-side refrigerant emerging from the compressor.

14. The air conditioner according to claim 13, wherein the at least one compressor comprises a plurality of compressors, further comprising a common accumulator which connects the compressors.

* * * * *